United States Patent [19]

Thomas, deceased et al.

[11] Patent Number: 4,838,308

[45] Date of Patent: Jun. 13, 1989

[54] MULTIPURPOSE CONTROL VALVE

[76] Inventors: Charles E. Thomas, deceased, late of Ramona, Calif.; by Vivian Thomas, executrix, 97 Gladstone Avenue, Chatham, Ontario N7L 2C5, Canada

[21] Appl. No.: 108,952

[22] Filed: Oct. 16, 1987

[51] Int. Cl.[4] ..... F15B 13/043

[52] U.S. Cl. ..... 137/596.16; 137/596.14; 137/596.18

[58] Field of Search ..... 137/596.14, 596.15, 137/596.16, 596.18

[56] References Cited

U.S. PATENT DOCUMENTS

| | | | |
|---|---|---|---|
| 3,584,646 | 6/1971 | Olmstead | 137/596.18 |
| 4,026,193 | 5/1977 | Olmstead | 137/596.14 X |
| 4,067,357 | 1/1978 | Ruchser | 137/596.15 X |

FOREIGN PATENT DOCUMENTS

| | | | |
|---|---|---|---|
| 396511 | 1/1974 | U.S.S.R. | 137/596.14 |

*Primary Examiner*—Gerald A. Michalsky

*Attorney, Agent, or Firm*—Charmasson & Holz

[57] ABSTRACT

A three-port multipurpose pilot-operated vapor (air) or liquid (hydraulic) control valve with two semi-independent poppet segments which can be used for most basic control functions, including: two position (on-off), relief, pressure reducing and pressure control. The poppet segments are independent except for a poppet stem fixed to one segment but slidably attached to the second segment. This connection allows both pilot fluid pressure and main port pressure acting on the second poppet segment to partially control the movement of the first segment. A pilot piston may also be included to fully or partially control one or both poppet segments. The semi-independent poppet segments also allow the valve to function as a two-way when one segment is held closed. Combinations can also provide four-way control braking, counterbalance and regenerative functions. Conversion of multipurpose valve from one function to another, normally only requires minor adjustment.

6 Claims, 3 Drawing Sheets

MULTIPURPOSE CONTROL VALVE

FIELD OF THE INVENTION

This invention relates to valves, more specifically to pilot-operated fluid control valves.

BACKGROUND OF THE INVENTION

Fluid power systems require an exceptionally diverse range of control valves for the various tasks these systems perform. Fluid power systems are found in transportation vehicles, industrial facilities, defence systems, residential and commercial buildings. Applications range from a car jack to spacecraft guidance systems.

Fluid control valves are required for many different functions in these diverse systems. These functions include: actuation, venting, relief, pressure control, fluid counter balance, fluid braking, flow control, pressure reducing, blocking and sequencing. Single valves are also required to provide multiple functions with multiple ports.

The larger and more demanding applications generally require pilot operated control valves. The pilot valves provide small amounts of fluid at precisely controlled conditions, which then actuates and controls larger valves to provide larger amounts of precisely controlled fluid for the application.

Typically pilot operated fluid control valve has a spool piece which is displaced small distances by fluid pressures on one or both ends supplied by one or two pilot valves. Displacement of the spool piece controls fluid flow and/or pressure from one or more main fluid ports to other main fluid port(s). Displacement of the spool piece may also be affected by springs or other forces. A balance of fluid (at pilot and main ports) pressures acting against areas of spool piece creates a force, which when combined with spring or other forces against on the spool piece, determines it's position or movement with respect to restriction of one or more main ports.

Pilot operated fluid control valves may incorporate other features. Strainers or filters may be included to minimize the possibility of clogging of orifices or moving parts. Spool may be sectioned to provide adjustment or delay for multiport valves. Multiple independent spool pieces have also been combined in one valve body.

However, prior art control valves are not capable of major alterations of function without modifications. Pressure balance and forces on the spool piece can be varied, but basic operation remains unchanged in prior art valves. This is especially true of three-way and four-way multiport valves. A prior art three-way valve which doesn't provide a flow path between two ports, can not be adjusted to provide this connection. Spool piece segments could also not be actuated in simultaneous opposite directions for different ports. Thus, spool piece motion in prior art valves fixed a relationship between all ports which could not be altered without valve port or spool piece modification.

The inability to vary relationships among prior art fluid control valves has resulted in a proliferation of specialty multi-port valves to perform the wide variety of control functions required. This can create large inventories of spare parts required for large/complex fluid power systems. Economies of mass production are also lost for each specialized valve.

The inability to vary relationships has also resulted in multiple valves for single fluid control points. In order to achieve sufficient control, flapper valves have been used downstream of three-way or four-way valves to provide variable orifice control for multiport applications.

Leakage has also been a problem in some prior art valves, especially closed center three-way valves. Stroke length and other limitations precluded sufficient contact length to reliably seal, causing leakage in the closed position.

SUMMARY OF THE INVENTION

The principal and secondary objects of this invention are:

to provide a means to independently control fluid access among ports in multiport control valves;

to provide a standard multiport control valve capable of a wide variety of control functions;

to reduce the number of specialized valves required for complex fluid power systems or single control tasks;

to reduce inventory and manufacturing costs; and to provide leak-tight main port shutoff.

These and other objects are achieved by a multipurpose fluid control valve with movement of partially independent poppet segments controlled by a balance of pilot and main fluid pressures and/or other forces. Attached to one poppet segment is a poppet stem which extends through a bore in the other poppet segment, allowing one pilot pressure and one main port pressure to impact operation of both poppet segments. Other main port and pilot pressures impact only one of the poppet segments. Each poppet segment controls fluid passage across a valve seat between adjacent main fluid ports. A fluid piston and stem can also be provided to exert additional forces on either poppet segment, providing additional control capability. Springs can provide other closing and opening forces on the poppet segments. By combining alternatives and selecting appropriate dimensions for valve seats, poppet segments, poppet stem, spring constants and pilot pressures, a variety of control functions can be achieved including: actuation, pressure regulation, pressure reducing, venting, relief, fluid counterbalance, fluid braking, flow control, blocking and sequencing. A single multipurpose valve can also replace the combination of a three-way valve with variable downstream flapper valves because of its superior independent control capabilities.

DESCRIPTION OF THE PREFERRED EMBODIMENT OF THE INVENTION

Figure 1:
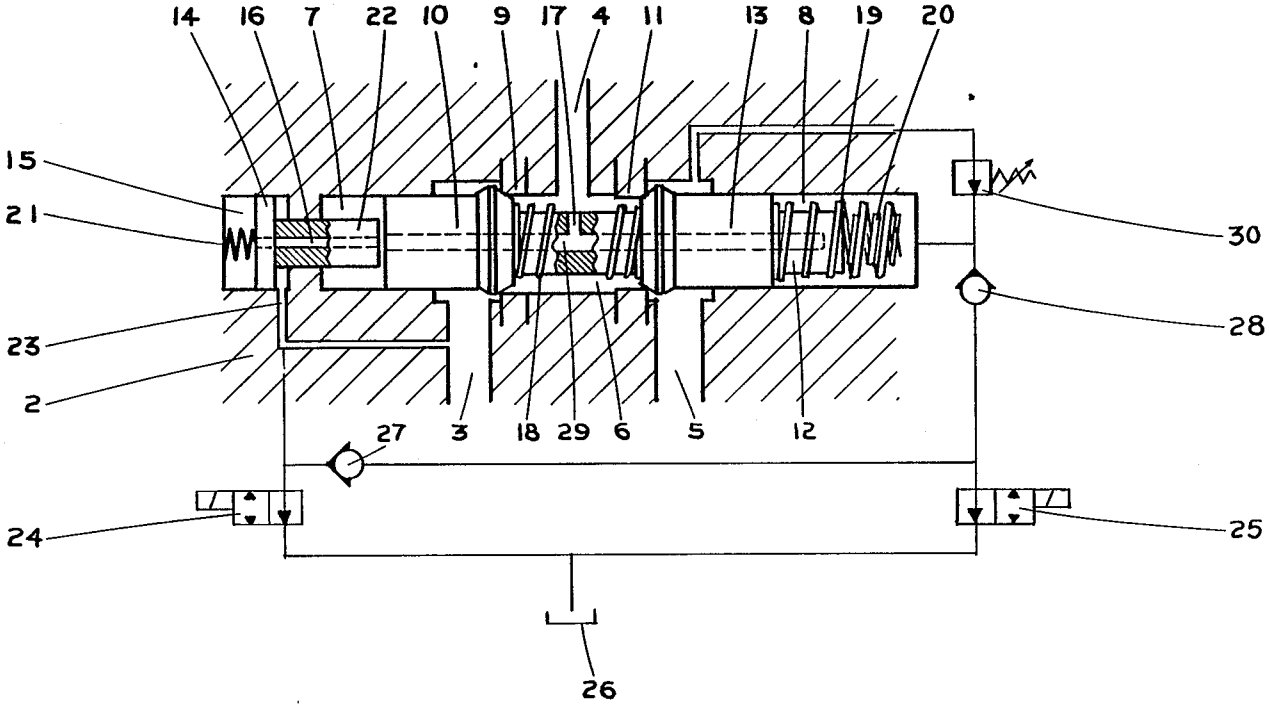
FIGS. 1 throughout 4 are schematic representations of a basic multipurpose valve in four fluid control positions.

FIG. 1 shows a schematic view of a basic multipurpose valve in a normal or closed position. The sectioned valve body 2 contains three main fluid ports: a pressure port 3; an actuator port 4; and a tank port 5. Fluid passage 6 connects main fluid ports and also extends beyond ports 3 and 5 to create pressure balance cavities 7 and 8. First valve seat 9 is placed in fluid passage 6 between adjacent main fluid ports 3 and 4. Poppet segment 10 is shown contacting valve seat 9, precluding main fluid passage to or from port 3 in this position. First poppet segment 10 also seals main port 3 from first pressure balance cavity 7 by matching poppet segment and fluid passage sliding contact surfaces between port 3 and pressure balance cavity 7.

Second valve seat 11 is placed in fluid passage 6 between adjacent fluid ports 4 and 5. Poppet stem 12 extends from first poppet segment 10 beyond second valve seat 11. Second poppet segment 13 is in slidable contact with fluid passage 6 and poppet stem 12 between main fluid port 5 and second pressure balance cavity 8. Second poppet segment 13 and stem 12 also seals main port 5 from other main ports when closed as shown. In the configuration shown in FIG. 1, a piston 14 sealing a piston chamber 15 have also been provided. Fluid from the first pressure balance cavity 7 is ducted through a piston bore 16 (shown dotted for clarity) to one side of piston 14 creating equal pressure in one portion of chamber 15. The remaining portion of chamber 15 is supplied with pilot fluid from a different source. Pressure in first and second pressure balance cavities 7 and 8 is supplied by fluid from main port 4 in this configuration by a poppet stem bore 17 (shown dotted for clarity), ducted through poppet stem 12 and poppet segment 10.

Force balance on poppets is achieved by main port pressures, fluid pressure in pressure balance cavities, fluid pressures in piston chamber, and several springs in this configuration. First spring 18 between poppet segments tends to force both poppet segments open (away from valve seats). Second spring 19 tends to close (move towards valve seat) second poppet segment 13. A third spring 20 also tends to open first poppet segment 10 via force against poppet stem 12. A fourth spring 21 tends to close first poppet segment 10 via force against piston 14 and piston stem 22.

Operation (controlled opening) of first poppet segment is achieved by increasing pilot fluid pressure against one side of piston 14. In this configuration, pilot fluid supply is from pressure port 3 through piston restrictor 23 to piston cavity 15. Closing is achieved by increasing fluid discharge past first or second solenoid operated pilot valves 24 and 25 to drain 26. Fluid flow through second pilot valve 25, if open, must have sufficient pressure to overcome resistance of first check valve 27 placed in connecting line to second pilot valve 25.

Opening operation of second poppet segment 13 is achieved by decreasing fluid pressure in pressure balance cavities 7 and 8, reducing resistance to the opening forces of first spring 18 and main actuator port 4 fluid pressure. Reduction in pressure at cavities 7 and 8 is achieved by opening second pilot valve 25, allowing pilot fluid discharge through second check valve 28, and second pilot valve 25 to drain 26. Closing pressure in pressure cavities 7 and 8 is achieved by pilot fluid flow in bore 17 past second restrictor 29 and/or flow from adjustable relief valve 30, from fluid sources in main ports 4 and 5, respectively. Adjustable relief valve 30 and porting can prevent excessive tank pressure from inadvertently actuating fluid actuator attached to main port 4 (not shown for clarity). High pressure fluid typically is supplied by a pump (not shown for clarity) connected to pressure port 3, which pump draws fluid from a low pressure tank attached to tank port 5 (not shown for clarity).

Figure 2:
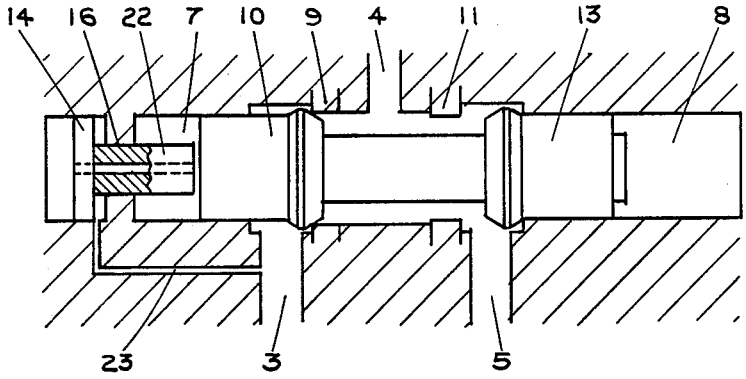

FIG. 2 shows a schematic cross section of a multipurpose valve with second poppet segment 13 open. This function is typically used for regulating or relieving actuator port 4 fluid to tank port 5. First poppet segment 10 remains closed. In this configuration pressure balance cavities 7 and 8 are not connected or exposed to actuator port 4 pressure via bore hole 17, but a means for independent pilot fluid may be by pilot valves (not shown for clarity). Piston 14, piston stem 22, bore 16, restrictor 23, and main port 3 function and positions remain the same as in FIG. 1. Springs 18 through 21 are not required in this configuration, poppet position being a function only of pressure balance.

Figure 3:
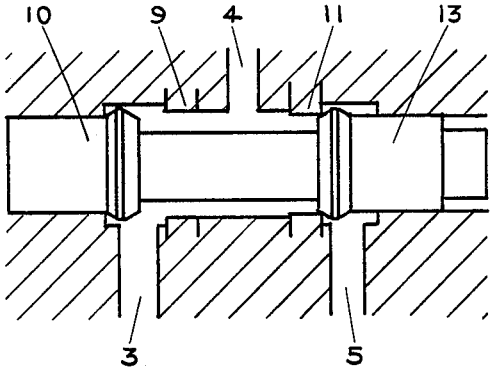

FIG. 3 illustrates a reducing or actuation position where first poppet segment 10 is open (uncovering valve seat 9). (Pressure balance cavities and pilot actuation systems are not shown for clarity.) It can be more easily seen in this figure the critical role of the diameters of valve seats 9 and 11 in relationship to fluid passage 6 diameter. Each valve seat diameter is different with valve seat 9 diameter being larger than valve seat 11 diameter. This allows a better balance of forces on poppet segments 10 and 13. Higher pressure at port 3 acts over smaller net area (a function of the difference in diameter) while lower tank pressure at port 5 acts over a larger net area to balance actuator pressure in middle port 4. The net area tank pressure at port 5 acts on poppet 13 is the difference between cavity 6 area in sliding contact with poppet 13 and valve seat 11 area.

Figure 4:
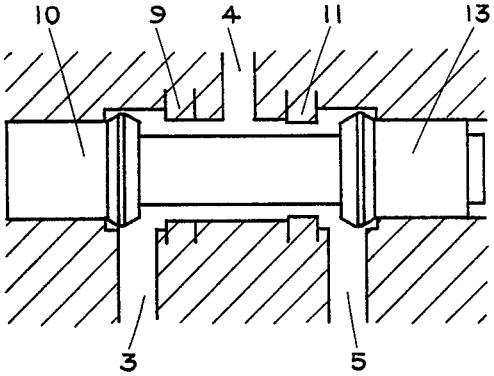

FIG. 4 illustrates a special position where both poppet segments 10 and 13 are open. This position allows fluid flow among all three main ports 3, 4 and 5. This position could be used for flushing or cascade applications.

Figure 5:
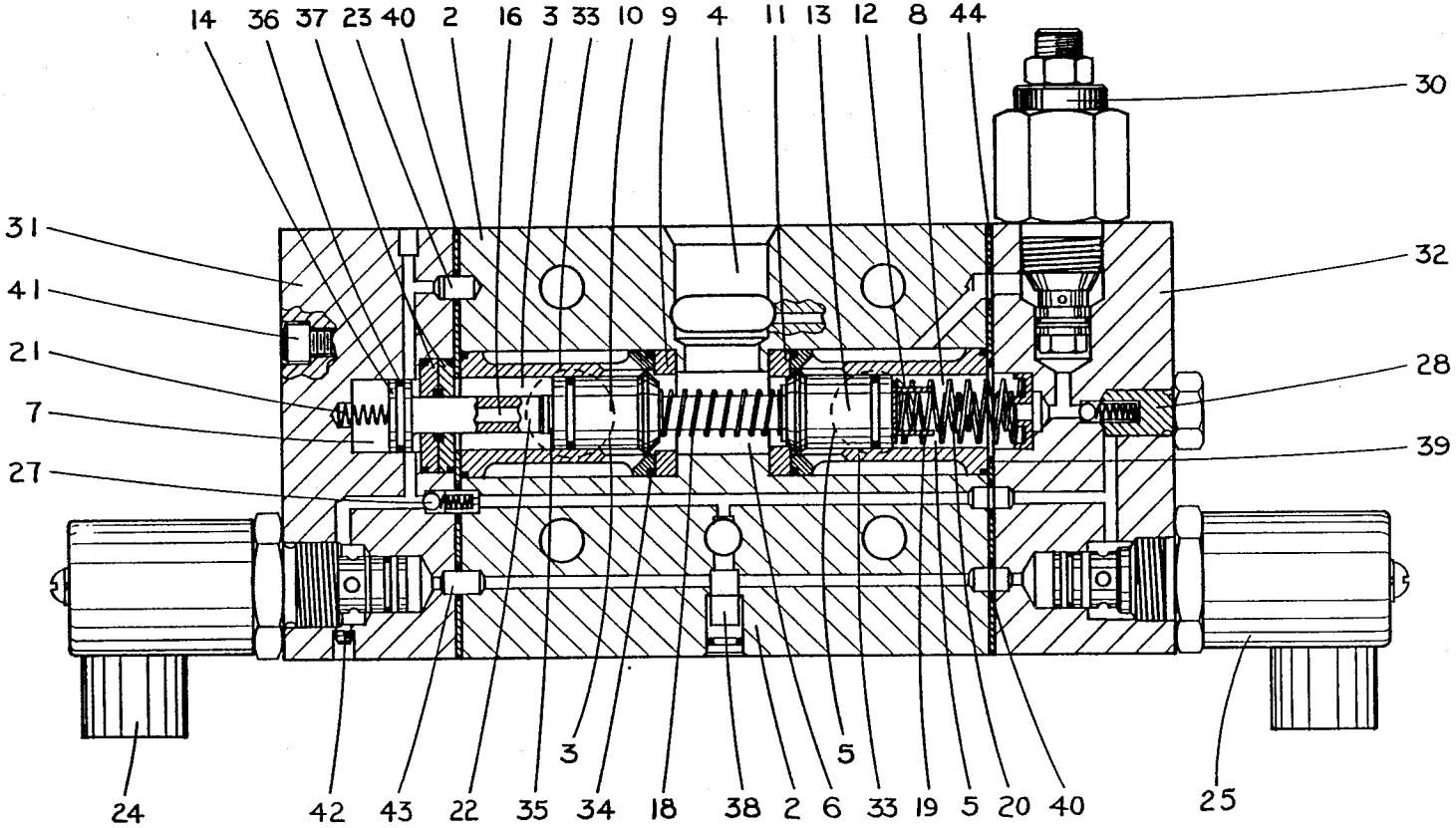
FIG. 5 is a cross-sectional view of a preferred embodiment multipurpose valve.

FIG. 5 shows an assembly cross section of another embodiment of a multipurpose valve. Valve body is now sectioned for ease of manufacturing and assembly into three components, the body section 2 and first and second end caps, 31 and 32. Main fluid ports 3 and 5 are shown dotted for clarity (behind assembly cross section). Main fluid port 4 gives access to poppet stem 12 and main fluid passage 6. To reduce cost, sleeves 33 now provide passage seals 34 to fluid passage 6 and a smooth bore to dynamically seal first and second poppet segments 10 and 13. Springs 18, 19, 20 and 21 function similar to FIG. 1 descriptions. Valve seals 9 and 11 also function similarly to FIG. 1 descriptions.

In this configuration, piston stem 22 is attached to first poppet segment by spring clip 35 as well as piston 14. Piston dynamic seal 36 and gland 37 with gland piston stem dynamic seal provide piston and piston stem dynamic seals. First 28 volt DC electric powered solenoid operated pilot valve 24, second solenoid operated valve 25, check valve 28, adjustable relief valve 30, check valve 27, orifice 23 and interconnecting pilot fluid conduits all function similar to FIG. 1 descriptions. The first solenoid valve 24 is biased open and the second solenoid valve 25 is biased closed.

Drain 26, is a common drain and can be provided with a manual operator 38 to override or replace solenoid pilot valves 24 and 25. Piston bore 16 is shown dotted for clarity. Other components (first and second static seals 39, 40, first and second screws 41 and 42, hollow dowels 43 and seal plates 44) assist in sealing and assembling other components.

While the preferred embodiment of the invention has been described and certain modifications thereto have been suggested, many other applications could be devised and other changes could be made without departing from the spirit of the invention and the scope of the claims.

What is claimed is:

1. A multipurpose fluid control valve which provides fluid control functions in a fluid system comprising:

a valve body;

first, second and third ports, in said valve body connected to control points within said fluid system;

a generally cylindrical fluid passage intersecting and connecting said first, second and third main fluid ports within said valve body at different axial locations of the fluid passage, said fluid passage including first and second outboard cavities each cavity extending beyond one of the outlying intersections of said main ports;

a first poppet segment in slidable contact with said fluid passage said first poppet segment shaped and dimensioned to preclude fluid passage between said first and second main ports at one end of sliding travel within said fluid passage, and shaped and dimensioned to allow fluid passage between said first and second main ports at the other end of sliding travel within said fluid passage, said first poppet segment also shaped and dimensioned to preclude fluid passage between said main ports and said first cavity throughout sliding travel;

a generally cylindrical poppet stem attached to first poppet segment within said fluid passage, extending from said first poppet segment towards the intersection of said fluid passage and third main port;

a second poppet segment in slidable contact with said fluid passage and in slidable contact with said poppet stem proximate to said intersection of said fluid passage and said third main port, said second poppet segment shaped and dimensioned to preclude fluid passage between said second and third main ports at one end of sliding travel within said fluid passage independent of the sliding position of said poppet stem, and said second poppet segment shaped and dimensioned to allow fluid passage between said second and third main ports at the other end of sliding travel within said fluid passage and also shaped and dimensioned to preclude fluid passage between said main ports and said second cavity throughout sliding travel;

means to supply a first pilot fluid to said first outboard cavity in said fluid passage;

means to supply a second pilot fluid to said second outboard cavity in said fluid passage;

a first spring placed proximate to said poppet stem within said fluid passage and biasing, said first and second poppet segments providing forces in opposite directions generally along said axis;

a second spring proximate to said second outboard cavity of said fluid passage and biasing, on said second poppet segment;

a third spring proximate to said second spring, biasing said poppet stem;

a piston cylinder cavity with an axis generally aligned with, and adjacent to, said first outboard cavity in said fluid passage within said valve body, said piston cavity connected to said first outboard cavity with an intercavity bore;

a piston in sliding contact with the inside surface of said piston cylinder cavity, said piston shaped and dimensioned to preclude fluid passage from a first portion of piston cavity to the other portion;

a piston stem attached to said piston, said piston stem extending through said intercavity bore and abutting the outboard portion of said seated first poppet segment at least one point of piston end travel, said piston stem shaped and dimensioned to preclude fluid passage between said first outboard cavity and one portion of said piston cavity:

a fourth spring placed proximate to one portion of said piston cylinder cavity biasing on said piston;

a piston bore within said piston and piston stem, allowing said first pilot cylinder fluid within first outboard cavity to one portion in said piston cylinder cavity; and means to supply third pilot fluid quantities to the remaining portion of said piston cavity.

2. A multipurpose valve as claimed in claim 1, wherein said means to supply first, second and third pilot fluid quantities comprises:

a poppet stem pilot bore within said poppet stem and first poppet segment, allowing pilot fluid passing between said second main port and said first and second outboard cavities;

a first pilot fluid restrictor placed between said second outboard cavity and said second main port within said said poppet stem bore;

a second pilot fluid conduit and adjustable set point relief valve, connecting and relieving pilot fluid at a set pressure from said third main fluid port to said second outboard cavity;

a third pilot fluid conduit and restrictor connecting said first main fluid port to a portion of said piston cavity on the side of said piston not containing said first pilot fluid;

a fourth pilot fluid conduit and first solenoid operated pilot valve connecting said third pilot fluid conduit at said piston cavity and a fluid drain;

a fifth pilot fluid conduit, having a first check valve and second solenoid operated pilot valve draining fluid from said second outboard cavity to said fourth pilot fluid conduit at an intersection proximate to said fluid drain;

a means to operate said solenoid operated pilot valves; and a sixth pilot fluid conduit and second check valve, draining pilot fluid from said fifth pilot fluid conduit at the intersection between said first check valve and second solenoid operated pilot valve, to said fourth pilot fluid conduit at an intersection between said piston cavity and first solenoid operated pilot valve.

3. A multipurpose valve as claimed in claim 2, wherein said first solenoid operated pilot valve is biased open and said second solenoid operated pilot valve is biased closed.

4. A multipurpose valve as claimed in claim 3, wherein said valve body comprises:

a center body section with said first, second and third main fluid ports, and a fluid passage connecting said main ports and opening to opposite edges openings of said center body section;

a first end cap attached to said center body section enclosing one opening of said fluid passage, said first end cap containing said piston and said piston cavity, said piston stem extending into said fluid passage within said center body section;

a second end cap attached to said center body section enclosing the other opening of said fluid passage;

means to attach said end caps to said center body section; and means to seal said fluid passages.

5. A multipurpose valve as claimed in claim 4 which also comprises a manually operated variable restrictor within said fourth fluid conduit located between said intersection of fourth and fifth pilot conduits, and said drain.

6. A multipurpose valve as claimed in claim 5, wherein said means to attach comprises threaded connectors, said means to seal comprises elastomeric rings and said means to operate said solenoid valves comprises 28 VDC electric power.

* * * * *